US005233848A

United States Patent [19]

Elam

[11] Patent Number: 5,233,848

[45] Date of Patent: Aug. 10, 1993

[54] HANDCUFF RESTRAINING APPARATUS

[76] Inventor: Dennis C. Elam, 2606 Pawnee, No. 8, Garden City, Kans. 67846

[21] Appl. No.: 858,566

[22] Filed: Mar. 27, 1992

[51] Int. Cl.[5] ..... E05B 75/00

[52] U.S. Cl. ..... 70/16

[58] Field of Search ..... 70/15-17; 119/126, 128

[56] References Cited

U.S. PATENT DOCUMENTS

| | | | |
|---|---|---|---|
| 647,735 | 4/1900 | Widmayer | 119/126 X |
| 2,324,183 | 7/1943 | Wilson | 70/16 |
| 3,146,614 | 9/1964 | Von Frantzius | 70/16 |
| 3,616,665 | 11/1971 | Rosenthal | 70/16 |
| 3,740,977 | 6/1973 | Stefansen et al. | 70/16 |
| 4,089,195 | 5/1978 | Lai | 70/16 |
| 4,186,688 | 2/1980 | Gaitan | 119/128 X |
| 4,741,051 | 5/1988 | Bible | 70/16 X |
| 4,840,048 | 6/1989 | Elam | 70/16 |
| 4,860,560 | 8/1989 | Lundelius | 70/16 |
| 5,007,257 | 4/1991 | Thompson | 70/16 |

FOREIGN PATENT DOCUMENTS

| | | | |
|---|---|---|---|
| 363156 | 11/1922 | Fed. Rep. of Germany | 70/16 |

*Primary Examiner*—Lloyd A. Gall
*Attorney, Agent, or Firm*—Phillip A. Rein

[57] ABSTRACT

An improved handcuff restraining apparatus including 1) a main handcuff assembly of a rigid, solid construction; 2) pivotal clasp members mounted on respective outer ends of the main handcuff assembly for clasping on a person's wrist area for apprehending and restraining purposes; and 3) a handle cover assembly mounted about the main handcuff assembly and providing an area for ease of holding and firmly grasping. The main handcuff assembly is provided with spaced upper and lower support plate members interconnected in a rigid manner and having aligned chain receiving openings to receive a restraining chain member therethrough.

8 Claims, 2 Drawing Sheets

HANDCUFF RESTRAINING APPARATUS

PRIOR ART

A patent search was not conducted on this specific structure but U.S. Pat. No. 4,840,048, issued Jun. 20, 1989, inventor being the applicant herein, Dennis C. Elam, entitled entitled "Handcuff Restraining Apparatus and Method of Use", is the most pertinent art.

PREFERRED EMBODIMENT OF THE INVENTION

In one preferred embodiment of this invention, an improved handcuff restraining apparatus includes 1) a main handcuff assembly; 2) a pair of pivotal clasp members connected to the main handcuff assembly; and 3) a handle cover assembly mounted on the main handcuff assembly.

The main handcuff assembly includes upper and lower support plate members having an intermediate spacer plate member mounted therebetween and a key ratchet lock assembly positioned between the upper and lower support plate members. Each of the upper and lower support plate members includes a main body section having arcuate bracelet sections integral with respective opposite ends thereof.

Each main body section is constructed of a solid steel sheet material having 1) an outer finger grasp wall; 2) an outer palm contact wall; 3) a pair of spaced key receiving openings; 4) cover connector holes to receive anchor members for connection of the handle cover assembly thereto; and 5) a rectangular chain receiving opening.

Each arcuate bracelet section is of generally "U" shape and having a pivot shaft hole on outer end portions thereof to pivotally connect respective ones of the pivotal clasp members thereon.

The upper and lower support plate members are substantially identical and mounted in an overlayed relationship about the intermediate spacer plate member to achieve an interconnected rigid support base.

The pivotal clasp members are substantially identical and known in the prior art being "C" shaped support members with lock teeth members thereon and pivotally mounted on a clasp pivot shaft mounted in respective ones of the pivot shaft holes.

The lock teeth members are operable in a conventional manner to engage and lock in a one-way manner with the key ratchet lock assemblies on the main handcuff assembly.

The handle cover assembly includes first and second handle members operable to be mounted against respective outer surfaces of the upper and lower support plate members and secured thereagainst by a cover anchor assembly.

Each of the first and second handle members are provided with a rectangular chain opening to be aligned with similar openings in the upper and lower support plate members to receive a connector chain member therethrough.

The cover anchor assembly includes a plurality of nut and bolt members which are mounted through the aligned cover connector holes in the first and second handle members and the upper and lower support plate members for anchoring together in a secure manner.

OBJECTS OF THE INVENTION

One object of this invention is to provide an improved handcuff restraining apparatus having a main handcuff assembly provided with interconnected upper and lower support plate members to form a solid, rigid interconnection between pivotal clasp members connected to outer end portions of the respective ones of the upper and lower support plate members to provide maximum rigidity therebetween.

Another object of this invention is to provide an improved handcuff restraining apparatus having a main central support portion with a rectangular chain opening therein operable to receive a waist or leg chain member therethrough thus providing a dual purpose and function of this invention by first restraining a person by a law enforcement officer and then serving as a means for connecting the person being restrained by a body or leg restraining chain member.

One other object of this invention is to provide an improved handcuff restraining apparatus having a main handcuff assembly with pivotal clasp members secured to outer ends thereof for grasping on the wrist area of a person being restrained and providing a solid, rigid structure whereby twisting action of the main handcuff assembly is operable to provide a pinching, painful reaction on the wrist area of the person being restrained.

A further object of this invention is to provide an improved handcuff restraing apparatus having a solid, rigid structure for ease of applying to a wrist area of a person to be restrained and having connector means thereon for ease of attaching a waist or leg chain to the person being restrained without requiring additional structures to achieve this desired function.

Still, one other object of this invention is to provide an improved handcuff restraining apparatus which is rigid in construction; easy to use; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
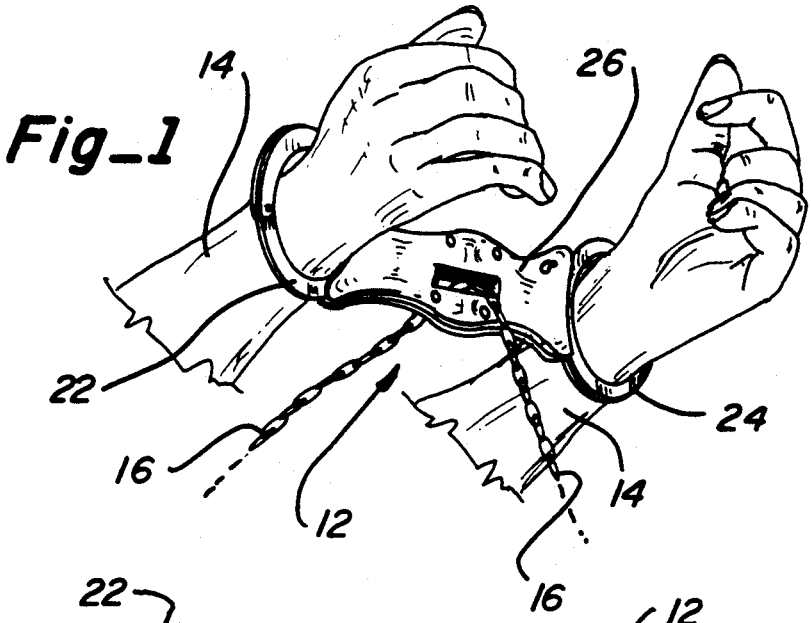
FIG. 1 is a perspective view of the improved handcuff restraining apparatus of this invention as attached to a person's wrist area of one being restrained thereby.

The following is a discussion and description of preferred specific embodiments of the improved handcuff restraining apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, an improved handcuff restraining apparatus of this invention, indicated generally at 12, is utilized to be releasably attached to a person's wrist area 14 that a law enforcement officer may be in the process of apprehending and restraining.

As noted in FIG. 1, a restraining chain member 16 is operable to be attached to the improved handcuff restraining apparatus 12 with the other ends of the restraining chain member 16 connected to ankle portions or a waist portion of the person being restrained or transported.

A complete description of a general operation and method of use of the improved handcuff restraining apparatus 12 is disclosed in the applicant's U.S. Pat. No. 4,840,048, issued Jun. 20, 1989, entitled "Handcuff Restraining Apparatus and Method of Use".

The improved handcuff restraining apparatus 12 includes 1) a main hancuff assembly 20; 2) a pair of pivotal clasp members 22, 24 pivotally connected to respective opposite ends of the main handcuff assembly 20; and 3) a handle cover assembly 26 which is mounted about and encloses the main handcuff assembly 20 as will be described.

The main handcuff assembly 20 includes 1) an upper support plate member 28; 2) a lower support plate member 30; 3) an intermediate spacer plate member 29 mounted between the upper and lower support plate members 28, 30; and 4) key ratchet lock assemblies also mounted between the upper and lower support plate members 28, 30.

As the upper and lower support plate members 28, 30 are substantially identical, only one need by described in detail. As noted in FIG. 4, the upper support plate member 28 includes a main body section 32 integral at each opposite end with an arcuate bracelet section 34.

The main body section 32 is provided with 1) a finger grasp wall 36 to receive a person's fingers thereagainst during usage; 2) a palm contact wall 38 to receive a palm portion of the hand of the person utilizing same; 3) a pair of key receiving openings 40 to receive a key member therein in a conventional manner; 4) a plurality, namely four (4), spaced cover connector holes 42 for attaching the handle cover assembly 26 thereto; and 5) a chain receiving opening 44.

The chain receiving opening 44 is of generally rectangular shape having clearance to receive interconnected links of the restraining chain member 16 therethrough as will be explained.

Each arcuate bracelet section 34 is of a generally "U" shape having an arcuate inner wall 46, a wrist restraining wall 48, and a pivot shaft hole 50 at an outer end thereon to pivotally connect the pivotal clasp members 22, 24, respectively, thereto as will be noted.

The intermediate spacer plate member 29 is provided with an arcuate body section 52 to conform generally to the outer periphery of the finger grasp wall 36 and the palm contact wall 38 in respective ones of the upper and lower support plate members 28, 30.

The intermediate spacer plate member 29 is operable to provide a rigid structure when in the assemblied condition and having a central opening therein to permit the restraining chain member 16 to pass through and having areas to receive and support the key ratchet lock assemblies.

The pivotal clasp members 22, 24 are substantially identical and known in the prior art as each having a "C" shaped support member 54 with outer lock teeth members 56 and mounted on a clasp pivot shaft 58. The clasp pivot shaft 58 is mounted within the pivot shaft holes 50 in each of the arcuate bracelet sections 34 of respective ones of the upper and lower support plate members 28, 30.

The lock teeth members 56 are engagable with a ratchet structure within respective ones of the key ratchet lock assemblies in the main handcuff assembly 20 in a conventional manner.

Figure 2:
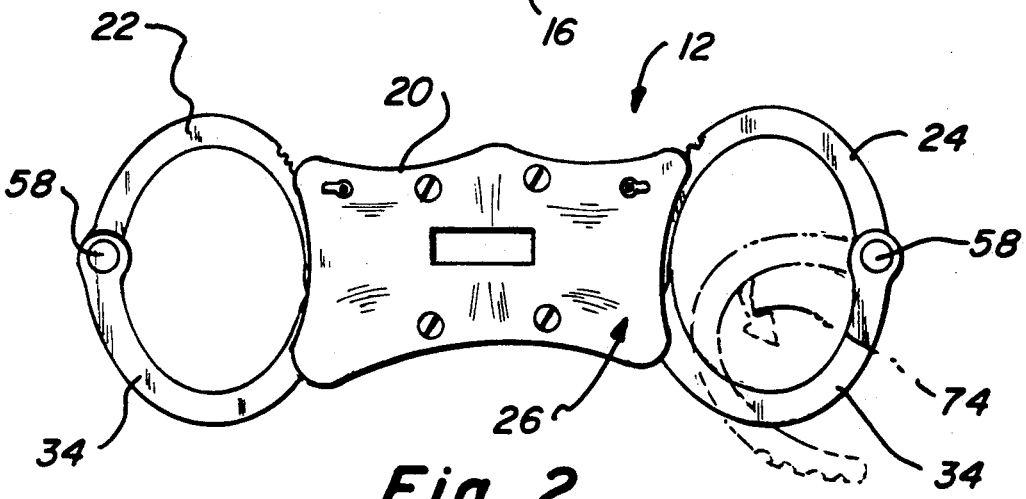
FIG. 2 is a top plan view thereof.

Each pivotal clasp member 22, 24 is movable in a one-way manner about the respective clasp pivot shaft 58 as noted by an arrow 74 in FIG. 2.

The use and operation of the pivotal clasp members 22, 24 are well known in the prior art and does not form a part of this invention.

Figure 3:
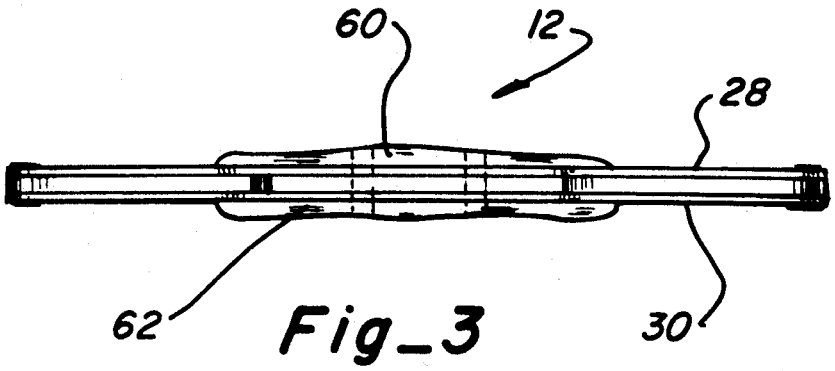
FIG. 3 is a side elevational view thereof.
Figure 4:
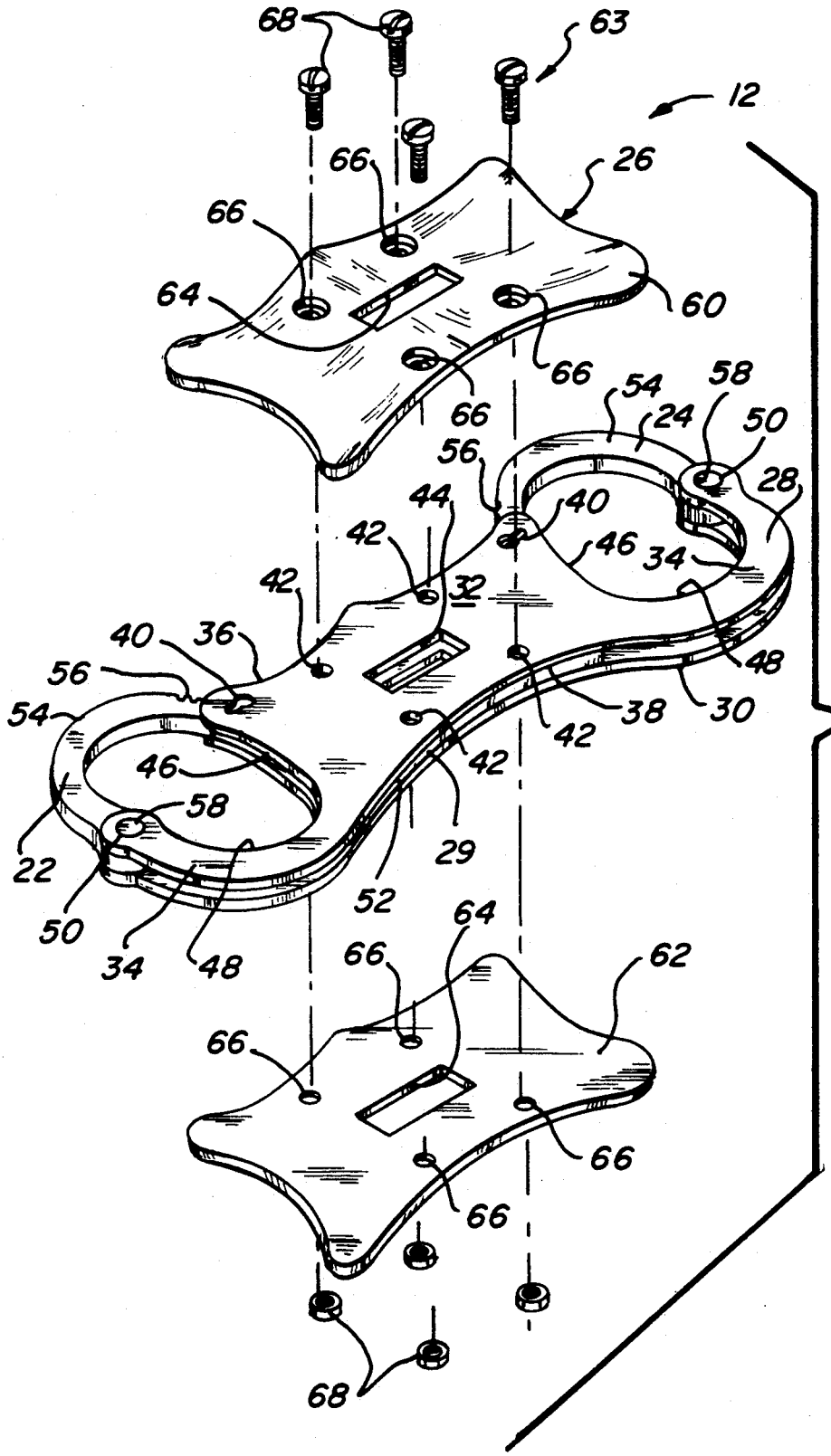
FIG. 4 is an exploded perspective view thereof.

As noted in FIG. 4, the handle cover assembly 26 includes 1) a first handle member 60; 2) a second handle member 62; and 3) a cover anchor assembly 63 to secure the first and second handle members 60, 62 about the main handcuff assembly 20 as noted in FIG. 3.

Each of the first and second handle members 60, 62 have a central rectangular chain opening 64 and a plurality, namely four, spaced connector holes 66 which are the same pattern as the cover connector holes 42 in the main body section 32 of each of the upper and lower support plate members 28, 30. The rectangular chain openings 64 are of similar size and shape to to the chain receiving openings 44 in the upper and lower support plate members 28, 30.

The cover anchor assembly 63 includes a plurality of nut and bolt members 68 having bolt members placed through aligned connector holes 66, 42 in the first and second handle members 60, and the upper and lower support plate members 28, 30 as shown in FIG. 4.

The first and second handle members 60, 62 can be constructed of a plastic or hard wood material having outer contoured finger and thumb surfaces, a thumb side wall, and an outer support wall with a curved surface to easily fit the hand of the person utilizing same for ease in applying to the person's wrist area 14 being restrained by a law enforcement officer.

Specific details of the outer contour of the first and second handle members 60, 62 and the specific method of use is fully set forth in U.S. Pat. No. 4,840,048, issued Jun. 20, 1989, entitled "Handcuff Restraining Apparatus and Method of Use", the inventor being the applicant herein.

USE AND OPERATION OF THE INVENTION

In the use and operation of the improved handcuff restraining apparatus 12 of this invention, it is readily attached to a person's wrist area 14 of one being apprehended or restrained by a law enforcement officer as set forth in U.S. Pat. No. 4,840,048.

One important feature of the improved handcuff restraining apparatus 12 is that the main handcuff assembly 20 is constructed with the upper support plate member 28 securely attached to the lower support plate member 30 with the intermediate spacer plate member 29 mounted therebetween through interconnection of the handle cover assembly 26 through the nut and bolt members 68. This achieves an overall rigid interconnection which is preferred over the prior art structures.

Another important feature of this invention is the provision of the chain receiving openings 64 in the handle cover assembly 26 aligned with the chain receiving openings 44 in the main body sections 32 of the upper and lower support plate members 28, 30. This allows law enforcement officers to not only utilize the improved handcuff restraining apparatus 12 in initial attachment to the person's wrist area 14 but allows the restraining chain member 16 to be utilized through the subject chain receiving openings 44, 64 and with the other ends of the restraining chain member 16 mounted about a waist portion or ankle portions of the person being restrained. This is very important as the restraining chain member 16 is required when transporting an incarcerated person between prison locations or to courthouses wherein the normal handcuff members do not have to be removed and a second structure utilized to achieve this operation utilizing the restraining chain member 16.

The improved handcuff restraining apparatus 12 achieves a new method step on usage thereof for use of the restraining chain member. The new method of use includes 1) holding the improved handcuff restraining apparatus 12 in the restraining officer's hand; 2) moving one of the clasp members 22 against the wrist area 14 of the suspect being apprehended; 3) inclining the main handcuff assembly 20 to provide presssure against a wrist nerve area of the suspect; 4) placing both of the clasp members 22, 24 on the suspect's respective wrist areas 14; and 5) placing the restraining chain member 16 through chain receiving openings 44, 64 in the handle cover assembly 26 and the upper and lower support plate members 28, 30.

It is noted that the improved handcuff restraining apparatus of this invention is easy to use; economical to manufacture; providing multiple use features and functions; and substantially maintenance free.

While the invention has been described in conjunction with preferred specific embodiments thereof, it will be understood this description is intended to illustrate and not to limit the scope of the invention, which is defined by the following claims:

I claim:

1. A method of restraining a suspect by an arresting officer utilizing an improved handcuff restraining apparatus, comprising:

a) holding said improved handcuff restraining apparatus in one of the arresting officer's hands, said improved handcuff restraining apparatus includes a main handcuff assembly with support plate members having pivotal clasp members connected to outer ends of said support plate members to provide a rigid structure;

b) moving one of the clasp members against the wrist area of the suspect and having the subject one of said clasp members secured about the wrist area;

c) inclining the main handcuff assembly on the wrist area of the suspect in such a manner so as to provide pressure against the nerve area of the subject clasped wrist area for subduing and controlling the suspect; and d) placing a restraining chain member through chain receiving openings in said support plate members with the restraining chain member connectable to a waist and/or ankle portion of the suspect.

2. An improved handcuff restraining apparatus adapted to be used by a law enforcement officer or the like to restrain a suspect, comprising:

a) a main handcuff assembly including a support plate member having a clasp member pivotally connected to respective outer ends of said support plate member;

b) a handle cover assembly mounted about opposite sides of said support plate member operable to receive the restraining officer's hand thereabout and provide firm gripping thereof so as to move said main handcuff assembly in an inclined and twisting manner as required;

c) said main handcuff assembly including upper and lower ones of said support plate members placed in overlying relationship and secured to each other to provide a solid, rigid interconnected structure between said clasp members pivotally connected to opposite ends of said upper and lower support plate members; and d) said upper support plate member and said lower support plate member each having a chain receiving opening therethrough whereupon a restraining chain member can be passed therethrough.

3. An improved handcuff restraining apparatus adapted to be used by a law enforcement officer or the like to restrain a suspect, comprising:

a) a main handcuff assembly including a support plate member having a clasp member pivotally connected to respective outer ends of said support plate member;

b) a handle cover assembly mounted about said support plate member operable to receive the restraining officer's hand thereabout and provide firm gripping thereof so as to move said main handcuff assembly in an inclined and twisting manner as required; and c) said support plate member and said handle cover assembly having a chain receiving opening therethrough whereupon a restraining chain member can be passed therethrough for attachment to a body portion of a suspect being restrained and/or transported.

4. An improved handcuff restraining apparatus as described in claim 3, wherein:

a) said chain receiving opening being of a rectangular shape to receive chain links of the restraining chain member therethrough.

5. An improved handcuff restraining apparatus adapted to be used by a law enforcement officer or the like to restrain and/or transport a suspect, comprising:

a) a main handcuff assembly including upper and lower support plate members secured to each other and having a pivotal clasp member mounted on respective outer adjacent ends of said upper and lower support plate members operable to form a solid, rigid interconnection for use in grasping and placing said pivotal clasp members about a person's wrist area being restrained;

b) a handle cover assembly mounted about and secured against outer surfaces of respective ones of said upper and lower support plate members; and c) said upper and lower support plate members and said handle cover assembly having a chain receiving opening therein to receive a restraining chain member for attachment to a body portion of the suspect being restrained and/or transported.

6. An improved handcuff restraining apparatus adapted to be used by a law enforcement officer or the like to restrain and/or transport a suspect, comprising:

a) a main handcuff assembly including upper and lower support plate members secured to each other and having a pivotal clasp member mounted on respective outer adjacent ends of said upper and lower support plate members operable to form a solid, rigid interconnection for use in grasping and placing said pivotal clasp members about a person's wrist area being restrained; and b) a handle cover assembly mounted about and secured against outer surfaces of respective ones of said upper and lower support plate members operable to receive the restraining officer's hand thereabout and provide firm gripping thereof.

7. An improved handcuff restraining apparatus as described in claim 6, wherein:

a) said upper and lower support plate members and said handle cover assembly having a chain receiving opening therethrough whereupon a restraining chain member can be passed therethrough for attachment to a body portion of a suspect being restrained and/or transported.

8. An improved handcuff restraining apparatus as described in claim 7, wherein:

a) said chain receiving opening being of a rectangular shape to receive chain links of the restraining chain member therethrough.

* * * * *